US006726308B2

(12) United States Patent
Lee et al.

(10) Patent No.: US 6,726,308 B2
(45) Date of Patent: Apr. 27, 2004

(54) BUBBLE-JET TYPE INK-JET PRINTHEAD

(75) Inventors: Chung-jeon Lee, Seoul (KR); Jae-ho Moon, Suwon (KR); O-keun Kwon, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1 day.

(21) Appl. No.: 09/798,954

(22) Filed: Mar. 6, 2001

(65) Prior Publication Data

US 2002/0012024 A1 Jan. 31, 2002

(30) Foreign Application Priority Data

Jul. 24, 2000 (KR) ..... 2000-42365

(51) Int. Cl.[7] ..... B41J 2/05
(52) U.S. Cl. ..... 347/48
(58) Field of Search ..... 347/48, 50, 62, 347/56, 65

(56) References Cited

U.S. PATENT DOCUMENTS

| | | | | | |
|---|---|---|---|---|---|
| 5,880,762 | A | * | 3/1999 | Ishinaga et al. | 347/62 |
| 6,273,557 | B1 | * | 8/2001 | Milligan et al. | 347/65 |
| 2002/0008741 | A1 | * | 1/2002 | Temple et al. | 347/68 |
| 2002/0021327 | A1 | * | 2/2002 | Ingham et al. | 347/44 |

FOREIGN PATENT DOCUMENTS

| | | | | | |
|---|---|---|---|---|---|
| EP | 0317171 | A2 | * | 5/1989 | 347/48 |
| JP | 59-124865 | | | 7/1984 | |
| JP | 359124865 | A | * | 7/1984 | 347/48 |
| JP | 08-048034 | | | 2/1996 | |

* cited by examiner

*Primary Examiner*—Thinh Nguyen
*Assistant Examiner*—Julian D. Huffman
(74) *Attorney, Agent, or Firm*—Robert E. Bushnell, Esq.

(57) ABSTRACT

A bubble-jet type ink-jet printhead is provided. The bubble-jet type ink-jet printhead includes a substrate, a plurality of chamber walls arranged parallel to one another on the substrate for dividing a chamber into a plurality unit chambers having a predetermined height, which are ink flow areas, a bubble generating means, provided for each unit chamber, which includes two unit heaters spaced apart by a predetermined distance on the substrate, and a nozzle plate, combined above the substrate, in which a plurality of nozzles are formed, each nozzle corresponding to a region between the two unit heaters of each bubble generating means. In this case, ink is supplied from both sides of the unit chamber. The ink-jet printhead is constructed such that a unit chamber is provided for each nozzle and bubbles are generated chamber on both sides of a nozzle within the unit chamber, thereby effectively preventing a back flow of ink while facilitating adjustment of the size of ink droplet ejected through the nozzle. Furthermore, the ink-jet printhead allows for high-speed and high-pressure ink ejection with relatively low pressure compared to a conventional printhead. In particular, an ink channel having a simple structure is provided, thereby avoiding the clogging of the ink channel due to foreign materials while effectively preventing defectiveness of the printhead.

51 Claims, 14 Drawing Sheets

BUBBLE-JET TYPE INK-JET PRINTHEAD

CLAIM OF PRIORITY

This application makes reference to, incorporates the same herein, and claims all benefits accruing under 35 U.S.C. §119 from my application entitled BUBBLE-JET TYPE INK-JET PRINTHEAD filed with the Korean Industrial Property Office on Jul. 24, 2000 and there duly assigned Serial No. 2000/42365.

BACKGROUND OF THE INVENTION

1. Field of the Invention

The present invention relates to an ink-jet printhead, and more particularly, to a bubble-jet type ink-jet printhead.

2. Description of the Related Art

The ink ejection mechanisms of an ink-jet printer are largely categorized into two types: an electro-thermal transducer type (bubble-jet type) in which a heat source is employed to form a bubble in ink causing ink droplets to be ejected, and an electro-mechanical transducer type in which a piezoelectric crystal bends to change the volume of ink causing ink droplets to be expelled.

Meanwhile, a bubble-jet type ink-jet printhead having an ink ejector needs to meet the following conditions. First, a simplified manufacturing process, the low manufacturing cost, and high volume production must be allowed. Second, to produce high quality color images, creation of small and minute satellite droplets that trail ejected main droplets must be prevented. Third, when ink is ejected from one nozzle or ink refills an ink chamber after ink ejection, cross-talk with adjacent nozzles from which no ink is ejected must be prevented. Fourth, for a high speed print, a cycle beginning with ink ejection and ending with ink refill must be as short as possible.

However, the above conditions tend to conflict with one another, and furthermore, the performance of an ink-jet printhead is closely related to the structures of an ink chamber, an ink channel, and a heater, the type of formation and expansion of bubbles associated therewith, and the relative size of each component.

In efforts to overcome problems related to the above requirements, ink-jet print heads having a variety of structures have been proposed in U.S. Pat. Nos. 4,339,762; 4,882,595; 5,760,804; 4,847,630; and 5,850,241, European Patent No. 317,171, and Fan-Gang Tseng, Chang-Jin Kim, and Chih-Ming Ho, "A Novel Micoinjector with Virtual Chamber Neck", IEEE MEMS '98, pp. 57–62. However, ink-jet printheads proposed in the above patents and literature may only satisfy some of the aforementioned requirements but do not completely provide an improved ink-jet printing approach.

SUMMARY OF THE INVENTION

To solve the above problems, it is an objective of the present invention to provide a bubble-jet type ink-jet printhead having a structure for effectively preventing a back flow of ink.

It is another objective of the present invention to provide a bubble-jet type ink-jet printhead in which an ink channel, along which ink flows, has a simple structure and ink is supplied smoothly.

It is still another objective of the present invention to provide a bubble-jet type ink-jet printhead that allows for minute adjustment in an ink ejection amount and ejection of a fixed amount.

It is yet still another objective of the present invention to provide a bubble-jet type ink-jet printhead that allows for high-speed operation by shortening an ink refill time.

It is further an object of the present invention to provide an ink jet printhead that produces uniform droplet size.

It is still further an object of the present invention to provide an ink jet ejection mechanism that has two heater units for each nozzle hole;

It is also an object of the present invention to provide an ink chamber that can be filled from two directions.

Accordingly, to achieve the above objectives, the present invention provides a bubble-jet type ink jet printhead including a substrate, a plurality of chamber walls arranged parallel to one another on the substrate for dividing a chamber into a plurality of unit chambers having a predetermined height, which are ink flow areas, a bubble generating means, provided for each unit chamber, which includes two unit heaters spaced apart by a predetermined distance on the substrate, and a nozzle plate, combined above the substrate, in which a plurality of nozzles are formed, each nozzle corresponding to a region between the two unit heaters of each bubble generating means. In the ink-jet printhead, ink is supplied from both sides of the unit chamber.

Furthermore, the two unit heaters of each bubble generating means are electrically coupled to each other. The two unit heaters may be integrated or spaced apart by a predetermined distance, between which an electrical connection member is disposed.

The opposite portions of the two unit heaters of the bubble generating means may be coupled to a common signal line and the exterior ends of the two unit heaters may be commonly coupled to one parallel connection member. Alternatively, the ends of one side of each bubble generating means are coupled to a serial connection member while the ends of the other side are coupled to electrical signal lines, respectively. The exterior ends of the two unit heaters of the bubble generating means may be connected to the parallel connection member integrated therewith, and the common signal line may be commonly coupled to the middle portions of a plurality of bubble generating means.

A first insulating layer may be disposed between the common signal line and the bubble generating means, and a contact hole for contacting the common signal line and a connection portion of both unit heaters of the bubble generating means may be formed in the first insulating layer. A second insulating layer may be formed on the uppermost surface of a stack structure including the bubble generating means and the chamber wall is formed on the second insulating layer.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1A:
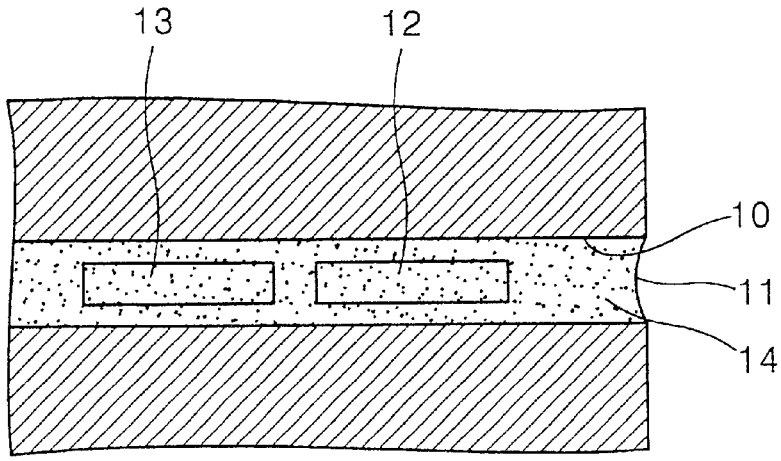
FIGS. 1A and 1B are cross-sectional views showing the structure of a conventional bubble-jet type ink-jet printhead along with ink ejection mechanism.
Figure 1B:
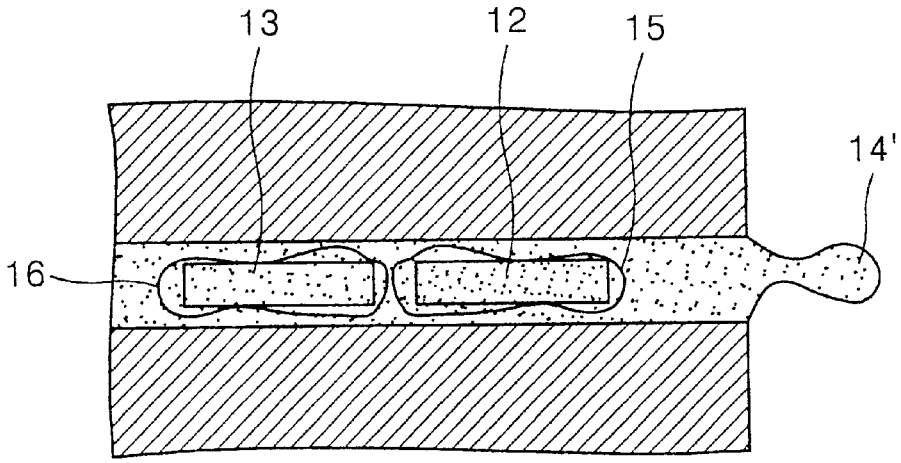

Referring to FIGS. 1A and 1B, a bubble-jet type ink ejection mechanism will now be described. When a current pulse is applied to a heater 12 consisting of resistive heating elements located at an ink channel 10 where a nozzle 11 is formed, heat generated by the heater 12 boils ink 14 forming a bubble 15 within the ink channel 10, which causes an ink droplet 14' to be ejected. A back flow of ink in the opposite direction of a nozzle must be avoided during ink ejection. Another heater 13 in FIGS. 1A and 1B is provided for this purpose.

Figure 2:
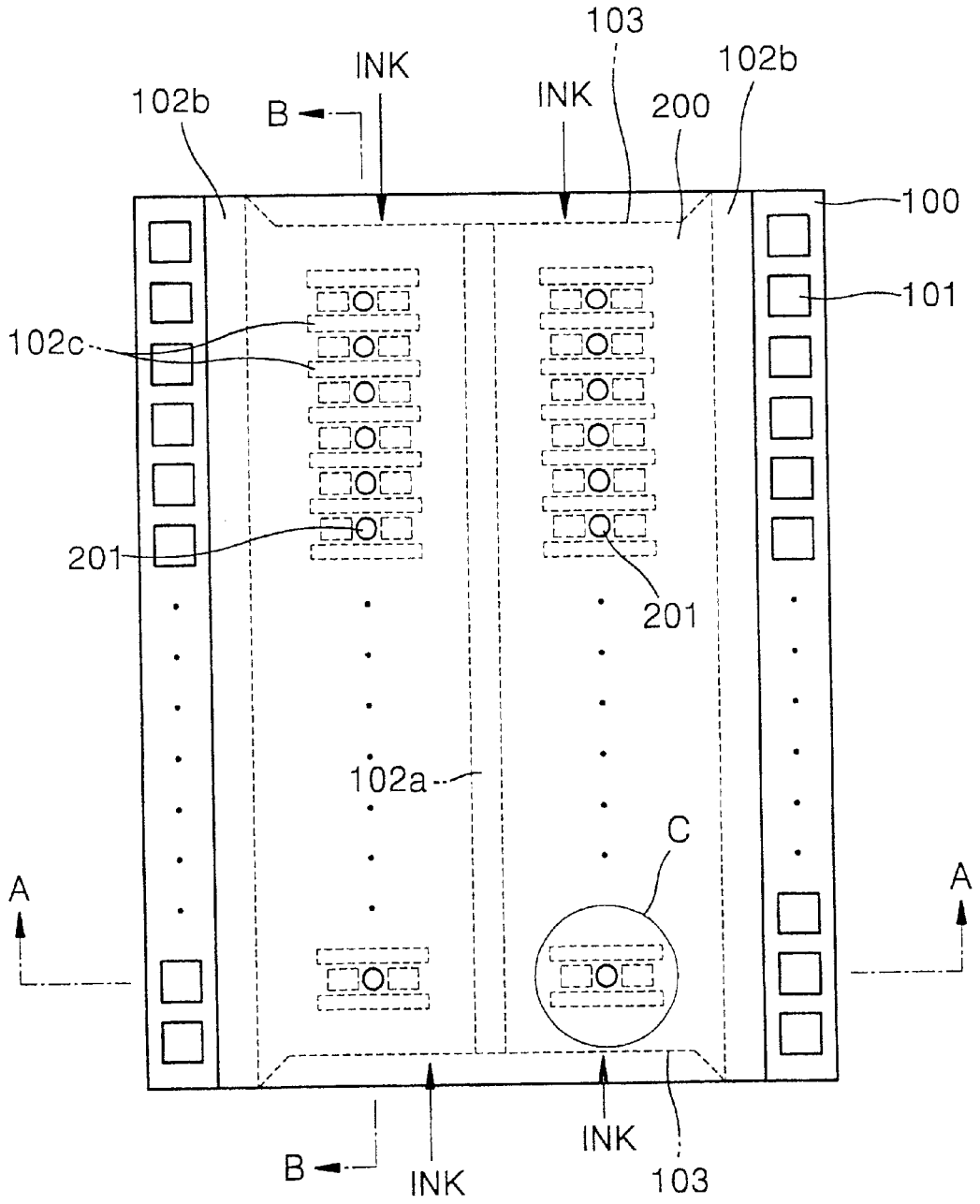
FIG. 2 is a schematic top view of a bubble-jet type ink-jet printhead according to an embodiment of the present invention.
Figure 3:
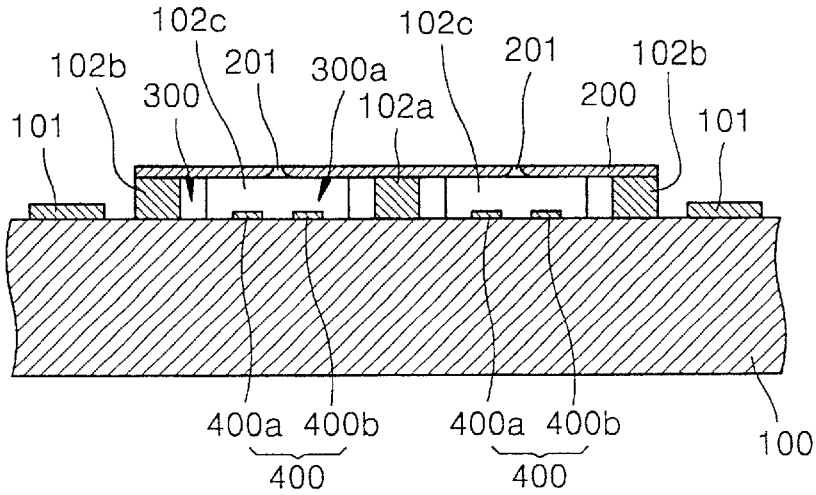
FIG. 3 is a cross-sectional view taken along line A—A of FIG. 2.

A heater is mainly shown in FIGS. 2 and 3, and components related thereto are omitted to aid in the understanding, and the detailed structure of the heater will be described separately. FIGS. 2 and 3 schematically show an ink-jet printhead having a structure in which nozzles 201 are arranged in two rows. Referring to FIGS. 2 and 3, a plurality of electrode pads 101 are arranged at predetermined intervals along both edges in the longitudinal direction of the substrate 100. A nozzle plate 200, in which the nozzles 201 are arranged in two rows, is disposed at the upper portion of the substrate 100. An isolation wall 102*a* extending from the middle portion of the substrate 100 in a longitudinal direction is disposed between the substrate 100 and the nozzle plate 200, and outer walls 102*b* are disposed along both edges in the longitudinal direction of the nozzle plate 200. Thus, an ink chamber 300 disposed between the substrate 100 and the nozzle plate 200 is partitioned into two, and ink is supplied to the ink chamber 300 through ink feed grooves 103 formed at both short sides of the substrate 100.

Meanwhile, a plurality of chamber walls 102*c* extending in a direction vertical to both outer walls 102*b* and the isolation wall 102*a* are arranged parallel to one another between each of the outer walls 102*b* and the isolation wall 102*a* in a direction in which the outer walls 102*b* and the isolation wall 102*a* extend. Both ends of the chamber wall 102*c* are separated from the outer wall 102*b* and the isolation wall 102*a* by a predetermined space. A unit chamber 300*a* isolated by the chamber wall 102*c* is provided for each nozzle, and the unit chambers 300*a* are connected to one another through openings between the ends of the chamber walls 102*c*. Unit heaters 400*a* and 400*b* constituting a symmetrical bubble generator 400 are disposed at the lower portion of the unit chamber 300*a*. As will be described later, the two unit heaters 400*a* and 400*b* of the bubble generator 400 for each nozzle 201 or unit chamber 300*a* are electrically coupled to each other, and the heaters 400*a* and 400*b* may have either parallel or serial connection structure. Also, both unit heaters 400*a* and 400*b* are arranged in a straight line parallel to the chamber walls between the chamber walls 102*c*, and the heaters 400*a* and 400*b* generate the same thermal energy, which causes bubbles of the same size to be formed.

Figure 4:
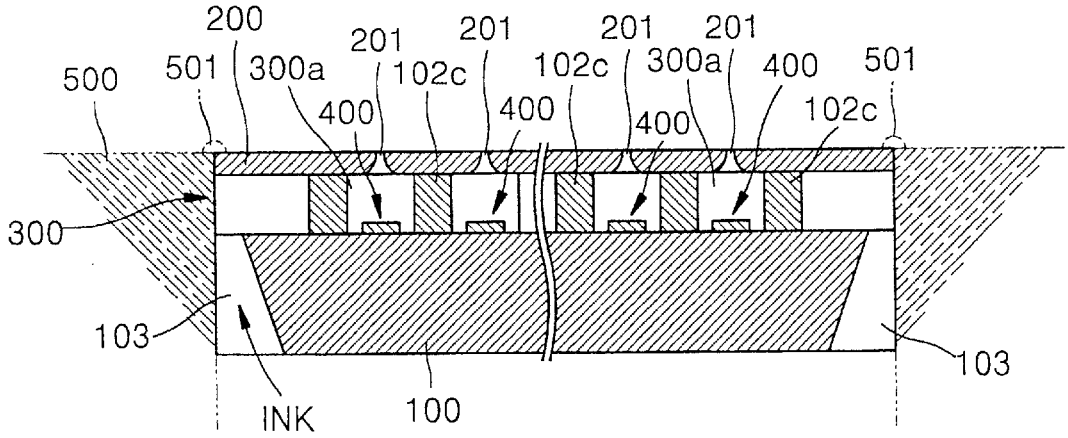
FIG. 4 is a cross-sectional view taken along line B—B of FIG. 2.
Figure 5:
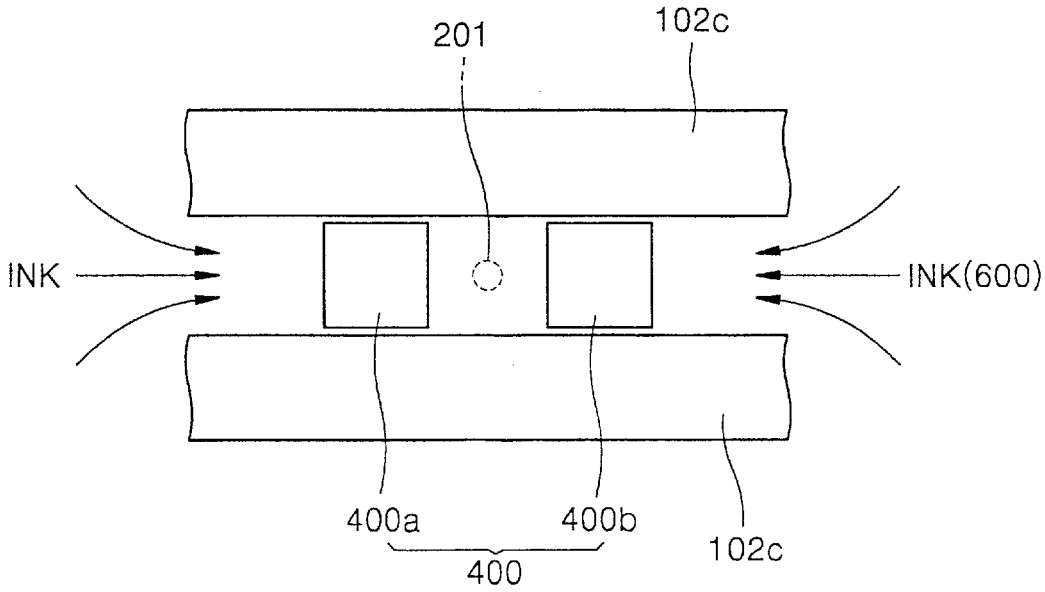
FIG. 5 is an extracted view showing the portion C of FIG. 2.

As shown in FIGS. 3 and 5 in detail, the nozzle 201 of the nozzle plate 200 is located at the upper center between the unit heaters 400*a* and 400*b*. Referring to FIG. 4, which is a cross-sectional view taken along line B—B of FIG. 2, the ink feed grooves 103 are disposed at both ends of the substrate 100. Reference numerals 500 and 501 denote a portion of an ink cartridge for storing ink and a sealing material for sealing the gap between the ink cartridge 500 and the nozzle plate 200.

Figure 6:
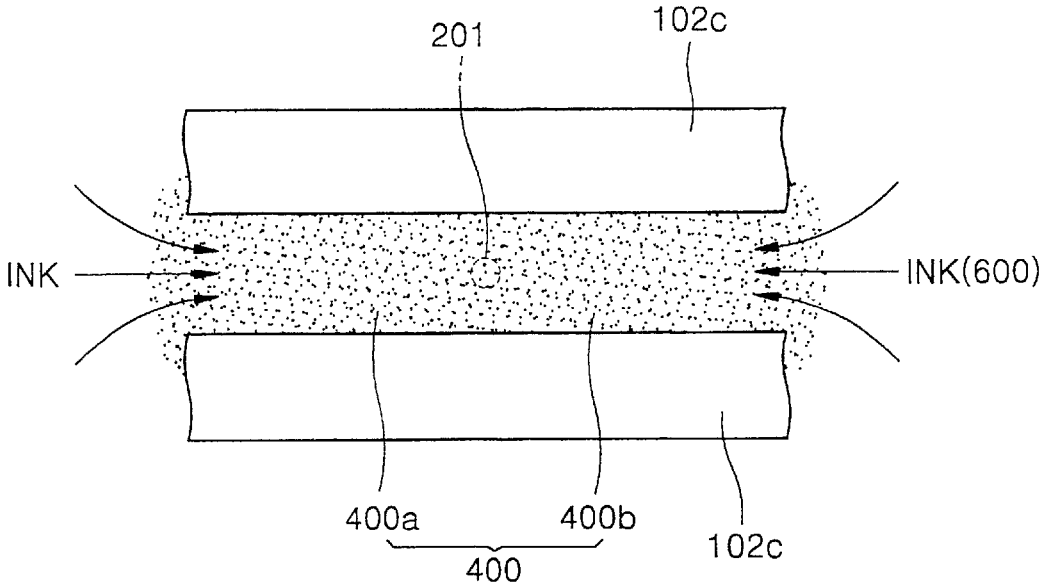
FIGS. 6–9B show an ink ejection process for a bubble-jet type ink-jet printhead according so to the present invention.
Figure 7:
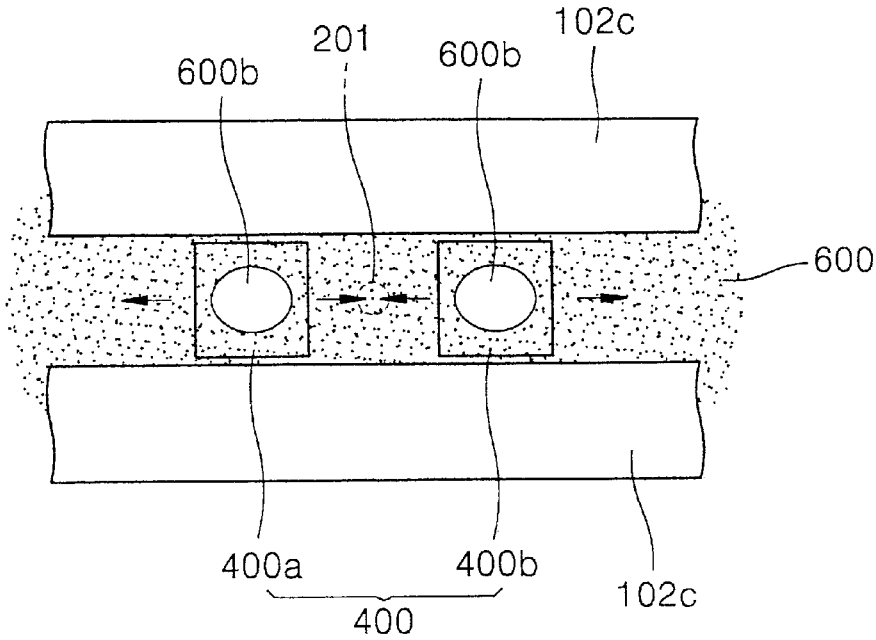

An ink ejection process in the ink-jet printhead according to the present invention having a distinctive structure as described above will now be described. FIG. 6 shows a state in which ink fills the unit chamber 300*a*. Ink 600 is introduced from both sides of the unit chamber 300*a*. In this case, the ink 600 is filled by capillary action and gravity. FIG. 7 shows an early stage at which bubbles are formed at a region in contact with the unit heaters 400*a* and 400*b* upon application of a voltage pulse to the unit heaters 400*a* and 400*b* of the bubble generator 400. In this case, bubbles 600*b* are generated by the unit heaters 400*a* and 400*b* disposed on both sides of a central axis that passes through the nozzle 201. As the bubbles 600*b* expand, pressure is applied to the ink 600 present between the bubbles 600*b* and the ink 600 on the outside thereof, causing a back flow of a small amount of ink 600.

Figure 8:
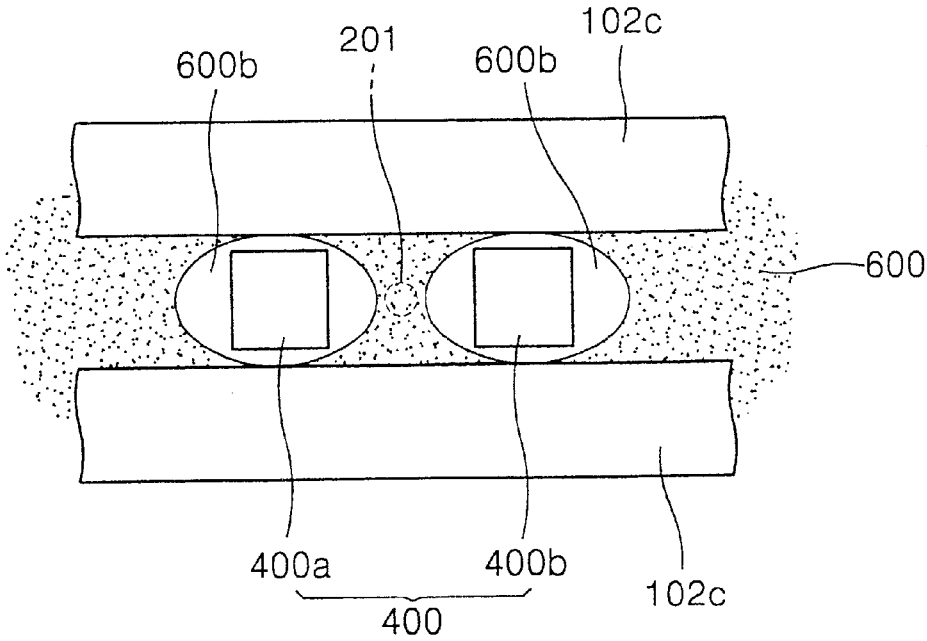

FIG. 8 shows a state in which the bubbles 600*b* formed by the unit heaters 400*a* and 400*b* expand so that a region between the bubbles 600*b* is closed as a voltage pulse continues to be applied to the unit heaters 400*a* and 400*b* of the bubble generator 400. Thus, the ink 600 present in the closed region by the bubbles 600*b*, that is, a region below the nozzle 201, begins to be ejected through the nozzle 201 by force applied by the expansion of the bubbles 600*b*.

Figure 9A:
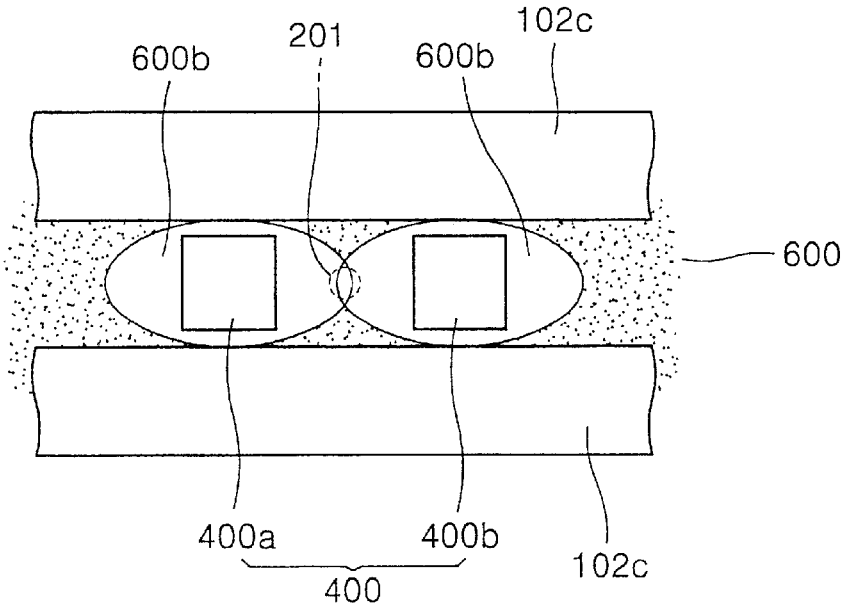
Figure 9B:
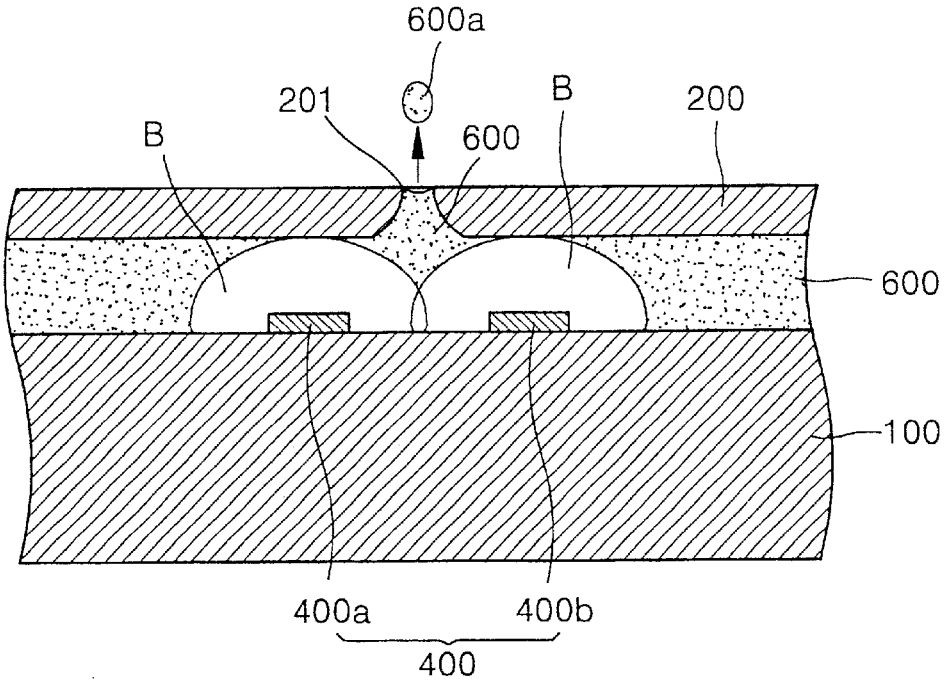

FIG. 9A is a top view showing a state in which the bubbles 600*b* generated by the unit heaters 400*a* and 400*b* reach their maximum growth as application of a voltage pulse to the unit 14 heaters 400*a* and 400*b* of the bubble generator 400 continues to complete ejection of the ink 600 present in the closed region between the bubbles 600*b* through the nozzle 201, and FIG. 9B is a side view showing the same state.

As shown in FIGS. 9A and 9B, the bubbles 600*b* fully expanded by the unit heaters 400*a* and 400*b* cause the ink 600 between the bubbles 600*b* to be ejected in droplets 600*a*. At the same time that ejection of the droplet 600*a* is complete in this way, a voltage ceases to be applied to the unit heaters 400*a* and 400*b* of the bubble generator 400 and hence the bubbles 600*b* that have reached maximum growth collapse and the ink 600 begins to refill. Thus, the process returns to an initial state shown in FIG. 5.

The structural features of the ink-jet printhead according to the present invention that ejects ink droplet through the above process are to include an isolated unit chamber provided for each nozzle and a bubble generator consisting of unit heaters disposed on both sides of the nozzle. Due to the structural features, as both bubbles generated by both unit heaters grow, ink below the nozzle is separated or isolated from the ink on the outside of the bubbles, thus preventing a back flow of the ink present below the nozzle. Furthermore, the ink below the nozzle is isolated by both bubbles and sufficient pressure is exerted on the ink, so as to generate a droplet which will be ejected with high pressure. Further, due to the structural features, it is possible to minutely adjust the size of a droplet ejected depending on the amount of heat generated by the bubble generator. The ink-jet printhead according to the present invention includes an ink channel having a simple structure unlike a conventional printhead, thereby effectively preventing the clogging of an ink channel due to foreign materials or the occurrence of cross-talk with adjacent regions.

Figure 10:
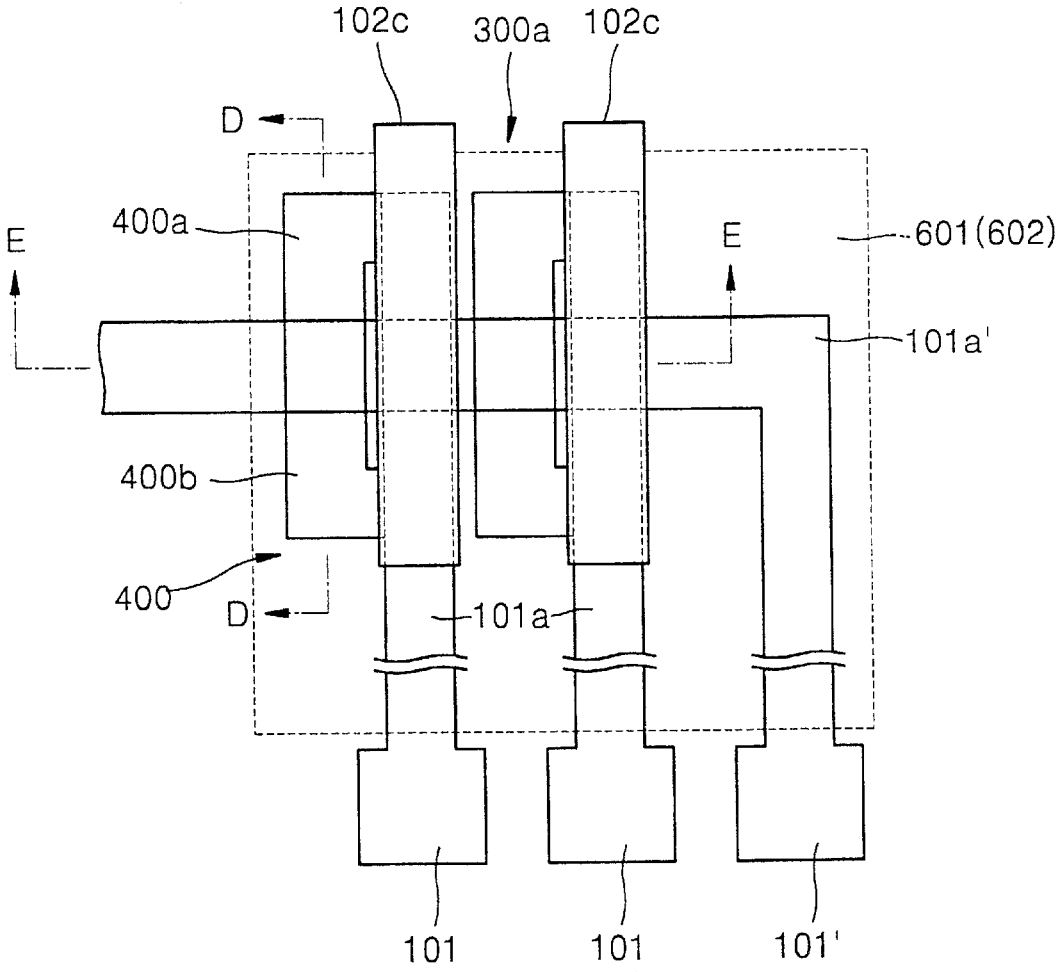
FIG. 10 is a top view showing the structure of a region around one unit chamber in the bubble-jet type ink-jet printhead according to the present invention.
Figure 11:
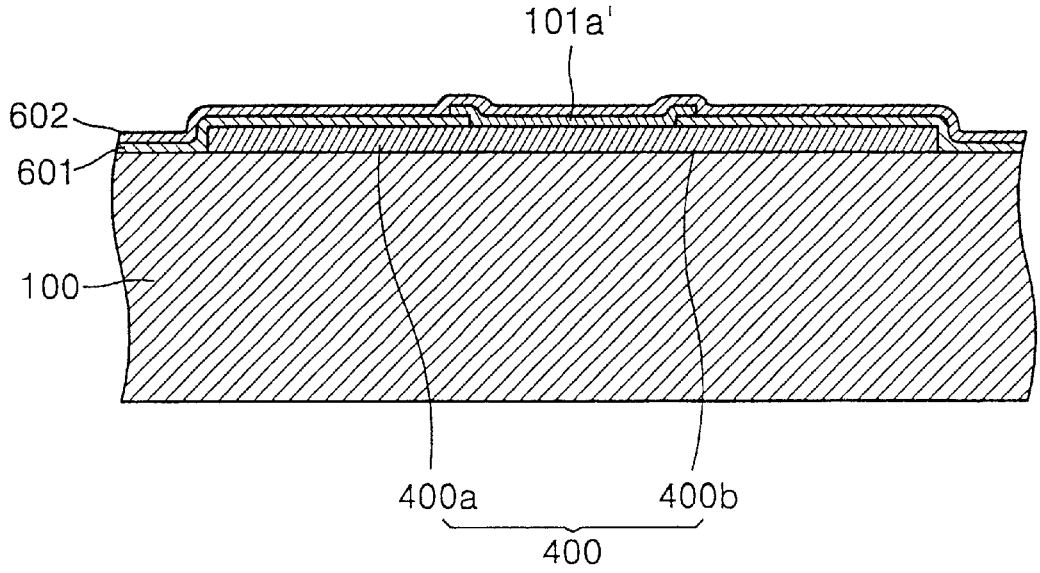
FIG. 11 is a cross-sectional view taken along line D—D of FIG. 10.

The detailed structure of the heaters 400*a* and 400*b* will now be described. FIG. 10 is a top view showing the arrangement structure of a portion around the unit chamber 300*a*. 601 and 602 denote insulating layers for insulating signal lines 101*a* and 101*a'* connected to the bubble generator 400 from each other. First, referring to FIGS. 10 and 11, the two unit heaters 400*a* and 400*b* of the bubble generator 400 unite into a single body, the middle portion of which is in contact with the common signal line 101*a'* coupled to the common electrode pad 101'. Thus, a resistance component at the portion in contact with the common signal line 101*a'* is shorted out of the circuit by the common signal line 101*a'* and hence both unit heaters 400*a* and 400*b* are connected in series by the common signal line 101*a'*. The common signal line 101*a'* is coupled to another bubble generator 400 as well. Further, the first insulating layer 601 is formed at a portion excluding the common signal line 101*a'* in the middle portion of the bubble generator 400, while the second insulating layer 602 is formed over the common signal line 101*a'* and the bubble generator 400.

Figure 13:
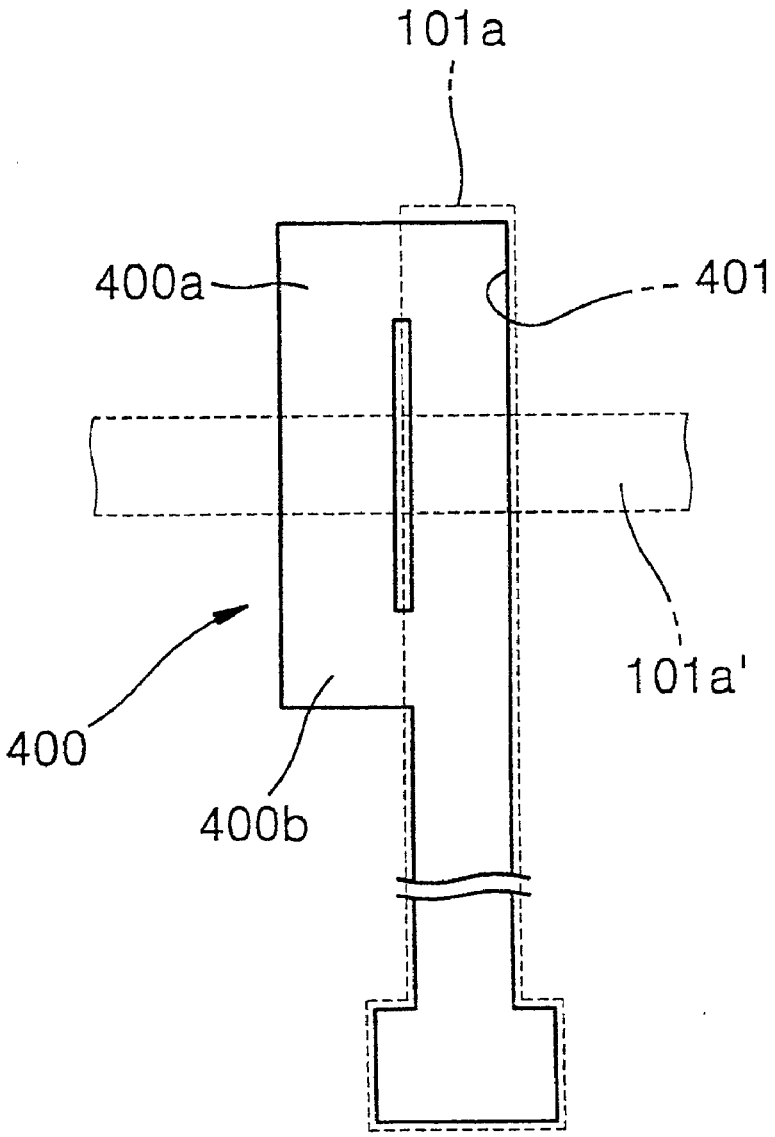
FIG. 13 illustrates a view of the electrical connections of a single bubble generator according to a first embodiment of the present invention.

FIG. 13 illustrates a view of the electrical connections of a single bubble generator according to the first embodiment of the present invention. Meanwhile, as shown in FIG. 13, a parallel connector 401, which is integrated with the bubble generator 400 and electrically connected to both ends of the bubble generator 400, is formed on one side of the bubble generator 400, on top of which an individual signal line 101*a* is formed. The individual signal line 101*a* extends longitudinally to be connected to the electrode pad 101. The individual signal line 101*a* and the electrode pad 101 are integrated with each other and formed on the parallel connector 401 consisting of resistors thus removing resistance component of the parallel connector 401 by an electrical short.

Figure 12:
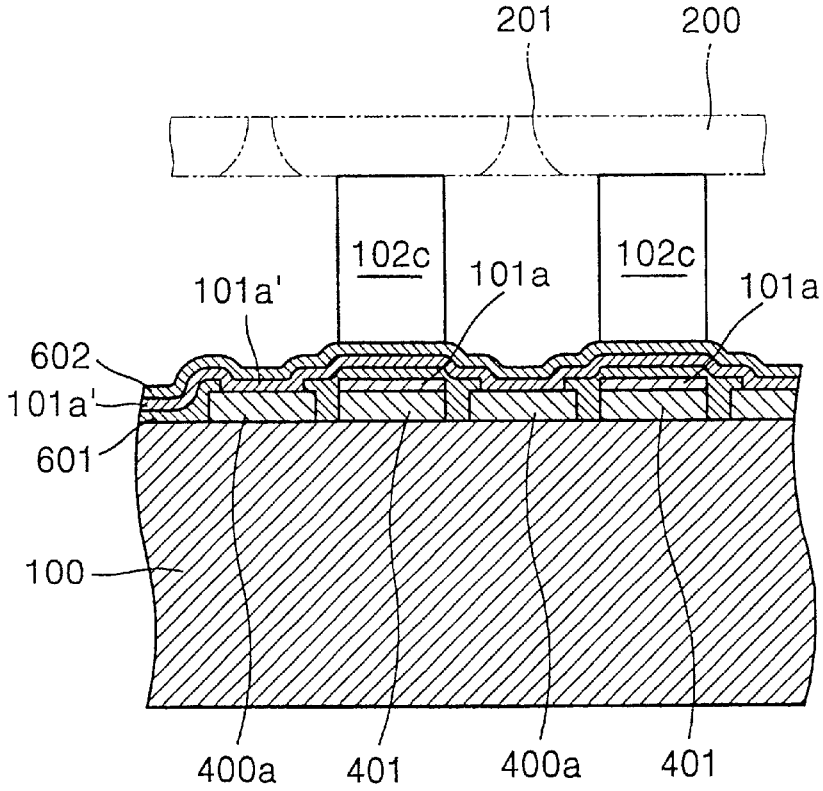
FIG. 12 is a cross-sectional view taken along line E—E of FIG. 10.

As shown in FIG. 12, the first insulating layer 601 is interposed between the parallel connector 401 and the common signal line 101*a*', thereby electrically separating the parallel connector 401 and individual signal line 101*a* from the common signal line 101*a*'. The second insulating layer 602 is positioned on the uppermost surface of the stack structure thereby protecting the unit heaters 400*a* and 400*b* of the bubble generator 400 from ink. The chamber wall 102*c*, the top surface of which contacts the bottom of the nozzle plate 200, is formed on the second insulating layer 602 with a predetermined height.

Figure 14:
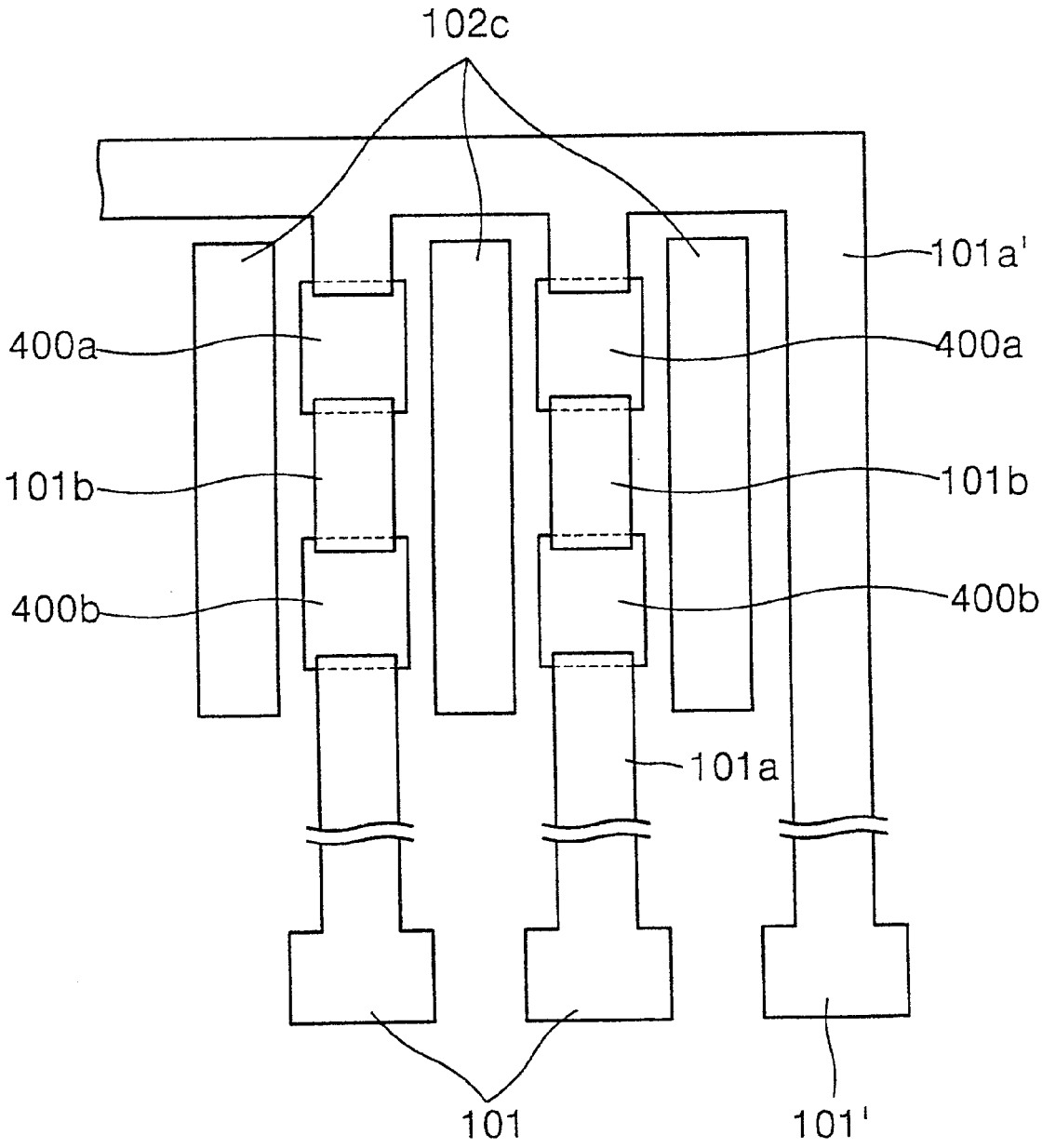
FIG. 14 illustrates a second embodiment of the present invention having a serial electrical connection structure.

In the bubble generator 400 and a peripheral structure associated therewith, the unit heaters 400*a* and 400*b* of the bubble generator 400 are electrically coupled to each other in parallel between the common signal line 101*a'* and the individual signal line 101*a* formed on the parallel connector 401. The parallel connection structure may be modified to a serial connection structure by appropriate arrangement of the signal lines. FIG. 14 illustrates a second embodiment of the present invention having this serial connection structure. In this case, as shown in FIG. 14, both unit heaters 400*a* and 400*b* of the bubble generator 400 are separated from each other, between which a serial connection unit 101*b* is interposed. Also, the outer portions of the unit heaters 400*a* and 400*b* may be coupled to a common signal line 101' and an individual signal line 101, respectively. In this case, the unit heaters 400*a* and 400*b* may be integrally connected and the serial connector 101*b* stacked on the middle portion of the integrated unit heater 400*a* and 400*b* corresponding to a nozzle, thereby obtaining the same serial connection effect.

The serial connector 101*b* can be applied to the bubble generator 400 shown in FIGS. 10–13. In this case, the unit heaters 400*a* and 400*b* integrally formed are separated and the serial connector 101*b* is interposed between the unit heaters 400*a* and 400*b*. The common signal line 101*a'* is connected to the serial connector 101*b*.

Figure 15A:
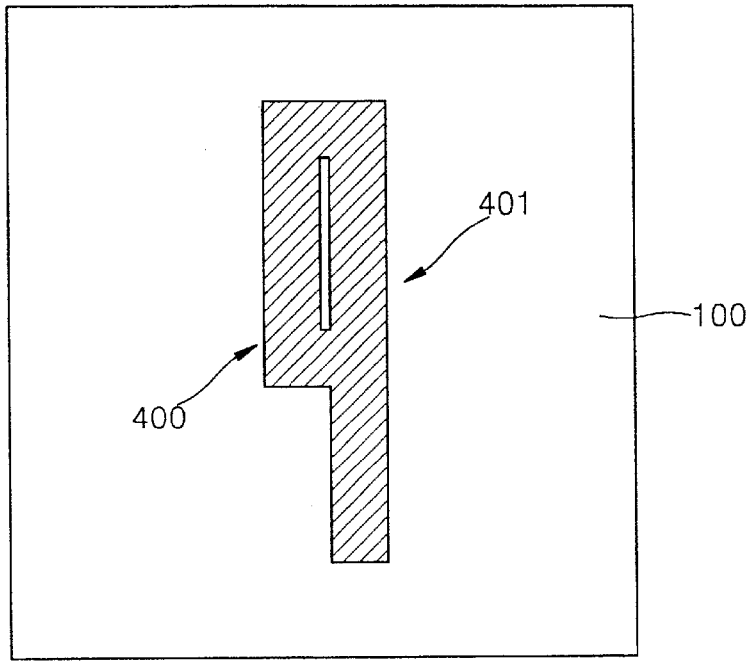
FIGS. 15A–15H show a process of forming a bubble generator applied to the bubble-jet type ink-jet printhead according to the present invention.

To aid in the understanding on the structures of the bubble generator 400 shown in FIGS. 10–13 and the bubble generator shown in FIG. 14, which is an applied example of the bubble generator shown in FIGS. 10–13, a process of forming the bubble generator 400 shown in FIGS. 10–13 will now be described. As shown in FIG. 15A, after having deposited a resistive material such as TaAl over the silicon substrate 100, the resistive material is etched by photolithography to form the bubble generator 400 and the parallel connector 401.

Figure 15B:
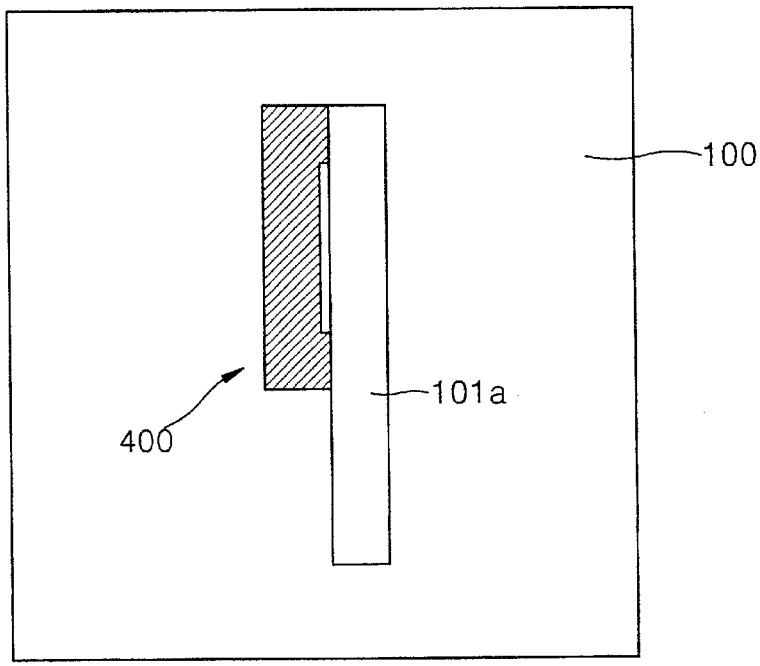
Figure 15C:
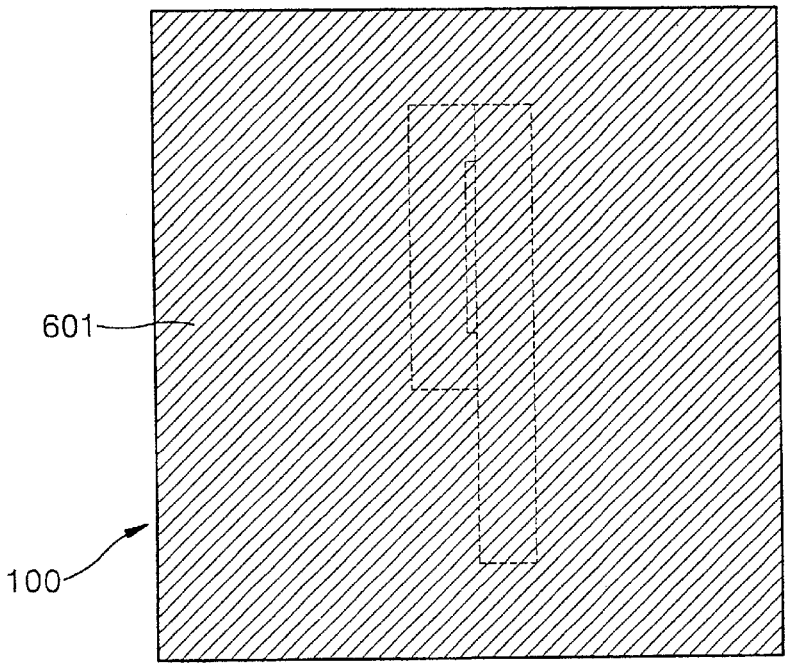
Figure 15D:
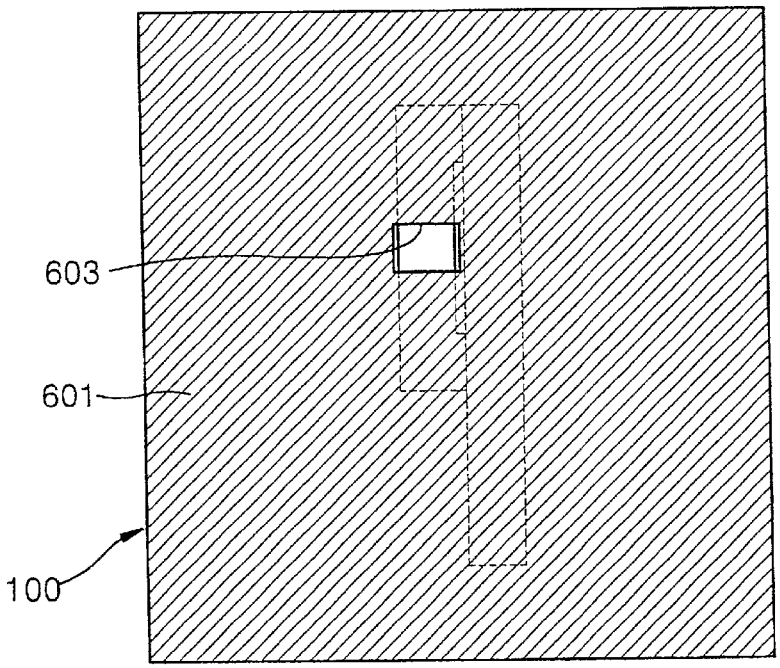
Figure 15E:
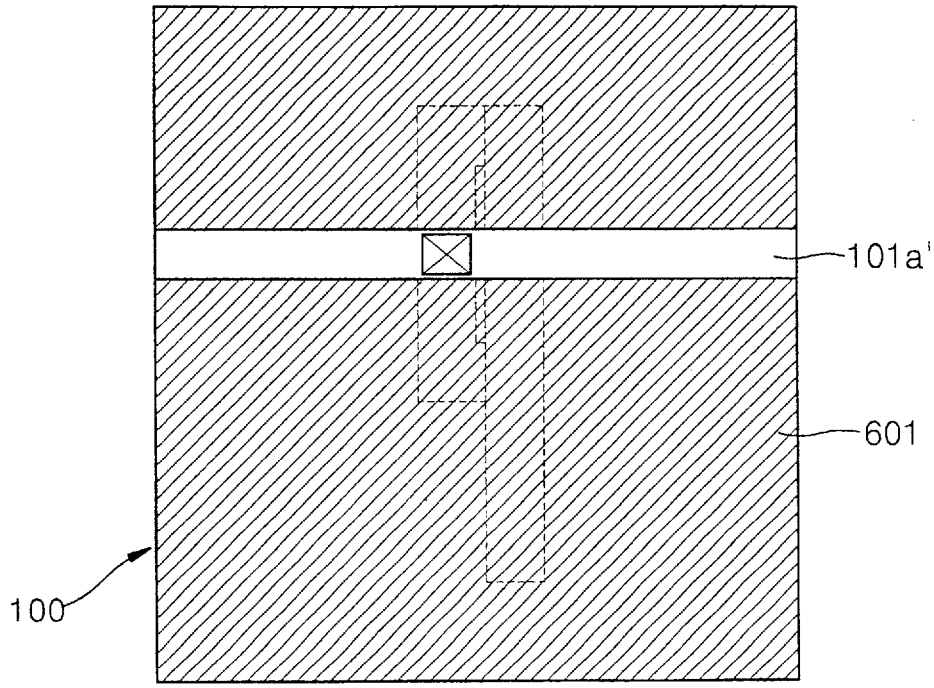

As shown in FIG. 15B, the individual signal line 101*a* is formed of a material having a high conductivity such as Al on the parallel connector 401 by means of deposition and etching. As shown in FIG. 15C, the first insulating layer 601 is formed over the substrate 100. As shown in FIG. 15D, a contact hole 603 is formed at the middle portion of the bubble generator 400 by photolithography. As shown in FIG. 15E, a material having a high conductivity such as Al is deposited over the first insulating layer 601 and then etched to form the common signal line 101*a'* which intersects the bubble generator 400 and overlaps the contact hole 603.

Figure 15F:
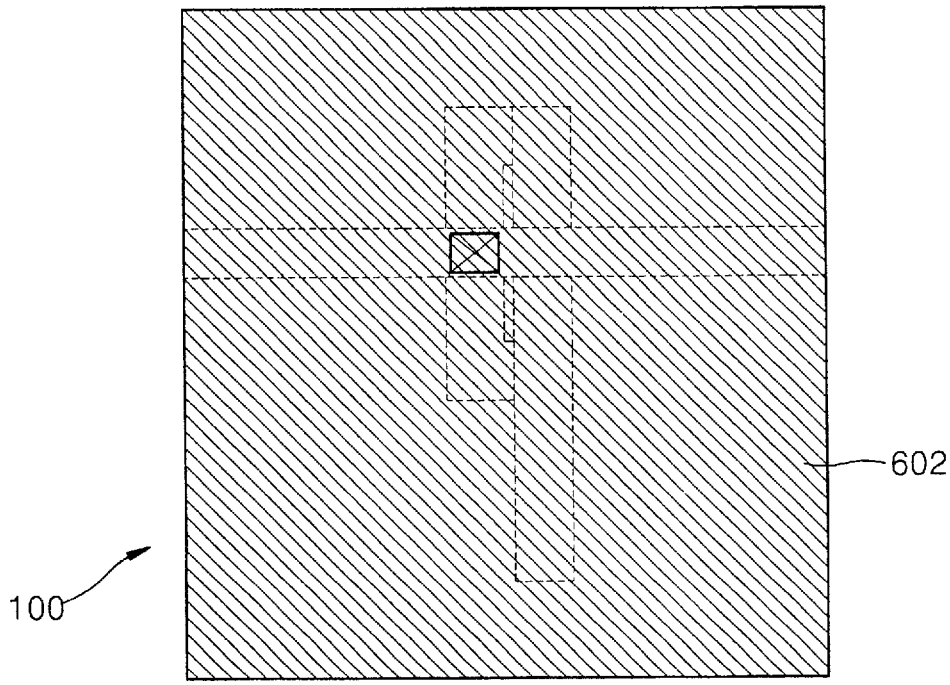
Figure 15G:
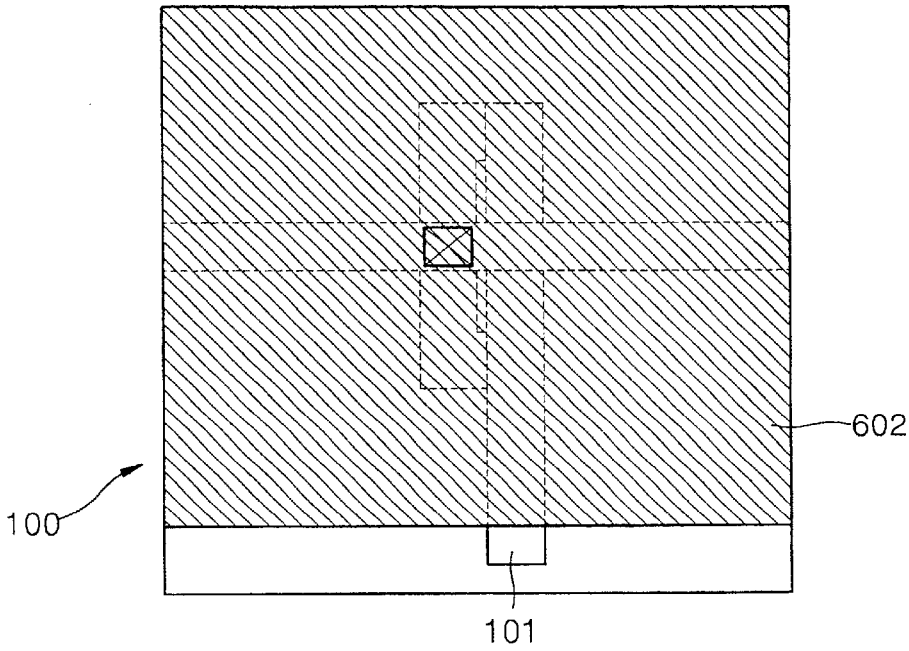

As shown in FIG. 15F, SiN or $SiO_2$ is deposited over the substrate 100 to form the second insulating layer 602, As shown in FIG. 15G, partial etching is performed on the second insulating layer 602 and the underlying first insulating layer 601 by photolithography so that a portion of the end of the individual signal line 101*a* may be exposed. Here, the exposed portion is the electrode pad 101.

Figure 15H:
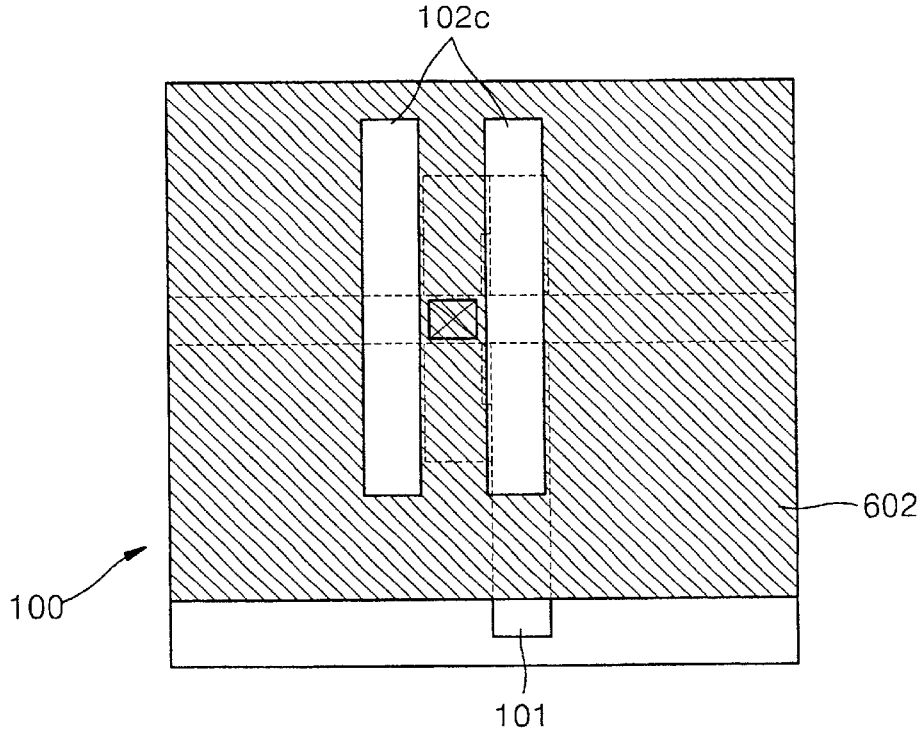

As shown in FIG. 15H, after having formed a film on the second insulating layer 602 by a thick-film forming process, the film is etched by photolithography to form the chamber walls 102*c* which extend parallel to the bubble generator 400 on either side of the bubble generator 400.

Etching techniques and film forming methods used in the above process are not described in detail. Of course, thin film growth and stacking and etching thereof, which are well known in the art, can be applied to the above process. In the ink-jet printhead according to the present invention as illustrated above, arrangement of a nozzle and a droplet generating structure associated therewith may be modified in various ways using the unit chambers and the bubble generator.

The ink-jet printhead according to the present invention can freely adjust the maximum amount of droplet ejected at one time within allowable range by controlling the interval between both heaters of the bubble generator, while ejecting droplets having a stable and uniform size.

Meanwhile, according to the ink-jet printhead shown in FIGS. 2–4, ink is supplied to the ink chamber on both short sides of the substrate. In addition to the structure, ink may be supplied to the chamber by forming a through hole that extends parallel to the isolation wall at the middle portion of two rows of the nozzles, that is, the portion adjacent to the isolation wall, or by removing the isolation wall and forming a long through hole instead.

As described above, the ink-jet printhead according to the present invention is constructed such that a unit chamber is provided for each nozzle and bubbles are generated chamber on both sides of a nozzle within the unit chamber, thereby effectively preventing a back flow of ink while facilitating adjustment of the size of ink droplet ejected through the nozzle. Furthermore, the ink-jet printhead according to the present invention allows for high-speed and high-pressure ink ejection with relatively low pressure compared to a conventional printhead. In particular, an ink channel having a simple structure is provided, thereby avoiding the clogging of the ink channel due to foreign materials while effectively preventing defectiveness of the printhead. Accordingly, the ink-jet printhead according to the present invention allows ink droplets to be ejected with a quick response rate and high driving frequency by virtue of the unit chamber and the ink feed channel.

What is claimed is:

1. A bubble-jet type ink jet printhead, comprising:

a substrate;

a plurality of barrier walls arranged parallel to one another on the substrate for dividing a common chamber into a plurality of unit chambers having a predetermined height, each of said plurality of unit chambers are ink flow areas;

a bubble generating device provided for each unit chamber, said bubble generating device comprising two unit heaters spaced apart by a predetermined distance on the substrate;

electrical leads supplying simultaneous power to both of said pair of said unit heaters causing both of said unit heaters to simultaneously heat up and form a respective pair of bubbles above corresponding ones of said pair of heaters to eject liquid ink; and a nozzle plate, attached to a top side of each of said plurality of barrier walls, said nozzle plate being perforated by a plurality of nozzle holes, each nozzle hole having a diameter less than said predetermined distance between said two heater units, an entire portion of each nozzle hole being disposed entirely in between said two unit heaters of a corresponding bubble generating device, ink being supplied from both sides of each unit chamber.

2. The printhead of claim 1, each one of said two unit heaters generates a bubble having the same size as another of said two unit heaters prior to ejection of ink through said nozzle hole.

3. The printhead of claim 2, the two unit heaters of each bubble generating device are integrated, each one of said pair of unit heaters having the same resistivity, shape and size as the other of said pair of unit heaters, each one of said pair of unit heaters having the same potential difference applied across said unit heater as another of said pair of unit heaters.

4. The printhead of claims 3, the unit heaters are arranged in a straight line parallel to the barrier walls and between the barrier walls, said unit heaters each generate the same thermal energy so as to form bubbles having the same size.

5. The printhead of claim 4, further comprising a second insulating layer disposed over a common signal line and a first insulating layer and the plurality of barrier walls being formed on top of said second insulating layer, said common signal line and said first insulating layer being disposed over said substrate.

6. The printhead of claim 3, sides of the two unit heaters of the bubble generating device that are facing each other are coupled to a common signal line, and wherein sides of the two unit heaters opposite said sides facing each other are coupled to an individual signal line electrically separate from said common signal line.

7. The printhead of claim 6, the nozzle plate being separated from the substrate by a predetermined space and a common chamber containing ink is disposed between the nozzle plate and the substrate.

8. The printhead of claim 3, sides of said two unit heaters facing each other are coupled to a serial connection unit while sides of said two unit heaters opposite said sides facing each other are coupled to electrical signal lines, respectively.

9. The printhead of claim 3, exterior ends of the two unit heaters of the bubble generating device are connected to an individual signal line integrated therewith.

10. The printhead of claim 9, further comprising a common signal line being electrically coupled to the middle portions of each bubble generating device.

11. The printhead of claim 10, further comprising a first insulating layer disposed between said common signal line and the bubble generating device, said first insulating layer being perforated by a contact hole providing electrical contact between the common signal line and a connection portion of both unit heaters.

12. The printhead of claim 11, further comprising a second insulating layer disposed over said common signal line and said first insulating layer and the plurality of barrier walls being formed on top of said second insulating layer, said common signal line and said first insulating layer being disposed over said substrate.

13. The printhead of claim 10, further comprising a second insulating layer disposed over said common signal line and a first insulating layer and the plurality of barrier walls being formed on top of said second insulating layer, said common signal line and said first insulating layer being disposed over said substrate.

14. The printhead of claim 9, further comprising a first insulating layer disposed between a common signal line and the bubble generating device, said first insulating layer being perforated by a contact hole providing electrical contact between the common signal line and a connection portion of both unit heaters.

15. The printhead of claim 14, further comprising a second insulating layer disposed over said common signal line and said first insulating layer and the plurality of barrier walls being formed on top of said second insulating layer, said common signal line and said first insulating layer being disposed over said substrate.

16. The printhead of claim 9, further comprising a second insulating layer disposed over a common signal line and a first insulating layer and the plurality of barrier walls being formed on top of said second insulating layer, said common signal line and said first insulating layer being disposed over said substrate.

17. The printhead of claim 3, further comprising a second insulating layer disposed over a common signal line and a first insulating layer and the plurality of barrier walls being formed on top of said second insulating layer, said common signal line and said first insulating layer being disposed over said substrate.

18. The printhead of claim 2, the two unit heaters of the bubble generating device are spaced apart by a predetermined distance, between which an electrical connection member is disposed.

19. The printhead of claim 18, the unit heaters are arranged in a straight line parallel to the barrier walls and between the barrier walls, said unit heaters each generate the same thermal energy so as to form bubbles having the same size.

20. The printhead of claim 19, further comprising a second insulating layer disposed over a common signal line and a first insulating layer and the plurality of barrier walls being formed on top of said second insulating layer, said common signal line and said first insulating layer being disposed over said substrate.

21. The printhead of claim 18, sides of the two unit heaters of the bubble generating device that are facing each other are coupled to a common signal line, and wherein sides of the two unit heaters opposite said sides facing each other are coupled to an individual signal line electrically separate from said common signal line.

22. The printhead of claim 21, the nozzle plate being separated from the substrate by a predetermined space and a common chamber containing ink is disposed between the nozzle plate and the substrate.

23. The printhead of claim 18, further comprising a second insulating layer disposed over a common signal line and a first insulating layer and the plurality of barrier walls being formed on top of said second insulating layer, said common signal line and said first insulating layer being disposed over said substrate.

24. The printhead of claim 2, the unit heaters are arranged in a straight line parallel to the barrier walls and between the barrier walls, said unit heaters each generate the same thermal energy so as to form bubbles having the same size.

25. The printhead of claim 24, comprising a second insulating layer disposed over a common signal line and a first insulating layer and the plurality of barrier walls being formed on top of said second insulating layer, said common signal line and said first insulating layer being disposed over said substrate.

26. The printhead of claim 2, sides of the two unit heaters of the bubble generating device that are facing each other are coupled to a common signal line, and wherein sides of the two unit heaters opposite said sides facing each other are coupled to an individual signal line electrically separate from said common signal line.

27. The printhead of claim 26, the nozzle plate being separated from the substrate by a predetermined space and a common chamber containing ink is disposed between the nozzle plate and the substrate.

28. The printhead of claim 2, sides of said two unit heaters facing each other are coupled to a serial connection unit while sides of said two unit heaters opposite said sides facing each other are coupled to electrical signal lines, respectively.

29. The printhead of claim 28, said electrical signal lines comprise:

a common signal line; and an individual signal line, wherein said individual line is held at a different potential than a potential of said common signal line.

30. The printhead of claim 2, further comprising a second insulating layer disposed over a common signal line and a first insulating layer and the plurality of barrier walls being formed on top of said second insulating layer, said common signal line and said first insulating layer being disposed over said substrate.

31. The printhead of claim 1, each pair of unit heaters are arranged in a straight line parallel to a pair of said plurality of barrier walls, a virtual ink chamber being disposed underneath each nozzle hole, each virtual chamber being bounded on two opposite sides by said pair of bubbles, one from each of said two unit heaters, and being bounded by said pair of barrier walls on another two opposite sides.

32. The printhead of claim 31, further comprising a second insulating layer disposed over a common signal line and a first insulating layer and the plurality of barrier walls being formed on top of said second insulating layer, said common signal line and said first insulating layer being disposed over said substrate.

33. The printhead of claim 1, further comprising a second insulating layer disposed over a common signal line and a first insulating layer and the plurality of barrier walls being formed on top of said second insulating layer, said common signal line and said first insulating layer being disposed over said substrate.

34. The printhead of claim 1, said two heaters and said nozzle hole being disposed in a straight line between a pair of said plurality of barrier walls.

35. The printhead of claim 34, said two heaters each producing a respective bubble upon application of electricity, each respective bubble filling a space between said pair of barrier walls resulting in said nozzle hole being disposed above a closed, rectangular-shaped virtual unit chamber of ink bounded on two opposite sides by bubbles generated by corresponding ones of said two heaters and on two remaining sides by respective ones of said pair of barrier walls.

36. The printhead of claim 35, said virtual unit chamber being bounded on a bottom side by said substrate and on a top side by said nozzle plate.

37. A bubble-jet type ink jet printhead, comprising:

a substrate;

a plurality of barrier walls arranged parallel to one another on the substrate for dividing a common chamber into a plurality of unit chambers having a predetermined height, each of said plurality of unit chambers are ink flow areas;

a bubble generating device provided for each unit chamber, said bubble generating means comprising two unit heaters spaced apart by a predetermined distance on the substrate; and a nozzle plate, attached to a top side of each of said plurality of barrier walls, said nozzle plate being perforated by a plurality of nozzle holes, each nozzle hole having a diameter less than said predetermined distance between said two heater units, an entire portion of each nozzle hole being disposed entirely in between said two unit heaters of a corresponding bubble generating device, wherein ink is supplied from both sides of each unit chamber and wherein a second insulating layer is formed over a common signal line and a first insulating layer and the plurality of barrier walls being formed on top of said second insulating layer, said common signal line and said first insulating layer being disposed over said substrate, said printhead being manufactured by a process comprising the steps of:

depositing, patterning, and etching a resistive material on a silicon substrate;

depositing, patterning, and etching an individual signal line over a portion of said resistive material;

depositing a first electrically insulating layer over said silicon substrate;

etching a hole in said first electrically insulating layer exposing a portion of said resistive material absent of said individual signal line;

depositing, patterning, and etching a common signal line, said common signal line being in electrical contact with said resistive material via said hole in said first electrically insulating layer;

depositing a second electrically insulating layer over said silicon substrate;

etching through a portion of said first and second insulating layers to expose a portion of said individual signal line in a region absent of said resistive material;

depositing, patterning, and etching a film to form a plurality of barrier walls, a first of said plurality of barrier walls being on top of a substantial portion of said individual signal line, and a second of said plurality of barrier walls being parallel to said first barrier wall, said second barrier wall being on an opposite side of said hole in said first insulating layer than said first barrier wall; and attaching a nozzle plate to a top portion of said plurality of barrier walls, said nozzle plate being perforated by a plurality of nozzle holes, one of said plurality of nozzle holes being directly above said hole in said first insulating layer.

38. A bubble-jet type ink jet printhead, comprising:

a substrate;

a plurality of barrier walls arranged parallel to one another on the substrate;

a plurality of bubble generators, a pair of said plurality of bubble generators being disposed between each pair of said plurality of barrier walls;

a first and a second electrically conductive signal lines both being electrically connected to opposite ends of each of said pair of bubble generators causing both of said pair of bubble generators to simultaneously heat up and produce two corresponding bubbles:

a nozzle plate attached to a top side of each of said plurality of barrier walls, said nozzle plate being perforated by a plurality of nozzle holes, each one of said plurality of nozzle holes being surrounded on two diametrically opposite sides by said pair of bubble generators and on another two diametrically opposite sides by a pair of barrier walls; and ink disposed in space between said substrate and said nozzle plate.

39. The printhead of claim 38, each bubble generator extending from a base of one of a pair of adjacent barrier walls to a base of another of said pair of adjacent barrier walls.

40. The printhead of claim 37, said each bubble generator being an electrically resistive layer deposited over portions of said substrate, said resistive layer heating up upon application of electricity to form bubbles in said ink above said bubble generator, said bubbles extending from one of an adjacent pair of barrier walls and another of a pair of barrier walls, said bubbles extending from said bubble generator on said substrate to said nozzle plate.

41. The printhead of claim 40, an electrically insulating layer being disposed between said resistive layer and said plurality of barrier walls.

42. The printhead of claim 38, a diameter of each of said plurality of nozzle holes being less than a distance between ones of said pair of bubble generators and being less than a distance between a pair of adjacent barrier walls.

43. The printhead of claim 38, a pair of bubble generators and a nozzle hole being disposed on opposite sides of each one of said plurality of barrier walls.

44. The printhead of claim 38, said pair of bubble generators comprising a first and a second bubble generator, said first signal line being electrically connected to a first end of both said first and said second bubble generators and said second signal line being electrically connected to a second end of both said first and said second bubble generators.

45. A bubble-jet type ink jet printhead, comprising:

a substrate;

a plurality of barrier walls arranged parallel to one another on the substrate;

a plurality of bubble generators, a pair of said plurality of bubble generators being disposed between each pair of said plurality of barrier walls, said pair of bubble generators being connected to electrically conductive signal lines causing both of said pair of bubble generators to heat up simultaneously;

a nozzle plate attached to a top side of each of said plurality of barrier walls, said nozzle plate being perforated by a plurality of nozzle holes, a space between each nozzle hole and a projection of said nozzle hole on said substrate being surrounded on two diametrically opposite sides by a pair of bubble generators and on another two diametrically opposite sides by a pair of barrier walls; and ink disposed in space between said substrate and said nozzle plate.

46. The printhead of claim 45, a diameter of each of said plurality of nozzle holes being less than a distance between ones of said pair of bubble generators and being less than a distance between a pair of adjacent barrier walls.

47. The printhead of claim 46, each bubble generator extending from a base of one of a pair of adjacent barrier walls to a base of another of said pair of adjacent barrier walls.

48. The printhead of claim 46, said each bubble generator being a electrically resistive layer deposited over portions of said substrate, said resistive layer heating up upon application of electricity to form bubbles in said ink above said bubble generator, said bubbles extending from one of an adjacent pair of barrier walls and another of a pair of barrier walls, said bubbles extending from said bubble generator on said substrate to said nozzle plate.

49. The printhead of claim 48, an electrically insulating layer being disposed between said plurality of barrier walls and said electrically resistive layer.

50. The printhead of claim 45, a pair of bubble generators and a nozzle hole being disposed on opposite sides of each one of said plurality of barrier walls.

51. A The printhead of claim 45, said pair of bubble generators simultaneously producing bubbles causing ink disposed underneath said nozzle hole to be pushed out through said nozzle hole.

* * * * *